US005533803A

United States Patent [19]

Meier

[11] Patent Number: 5,533,803

[45] Date of Patent: Jul. 9, 1996

[54] MAGNETIC STIRRING APPARATUS WITH CONTACTLESS COUPLING BETWEEN STIRRING SHAFT AND STIRRING TOOL

[75] Inventor: Hans P. Meier, Jona, Switzerland

[73] Assignee: MAVAG Verfahrenstechnik AG, Altendorf, Switzerland

[21] Appl. No.: 335,078

[22] Filed: Nov. 7, 1994

Related U.S. Application Data

[63] Continuation-in-part of Ser. No. 129,421, Sep. 30, 1993, abandoned.

[30] Foreign Application Priority Data

Oct. 1, 1992 [DE] Germany ..... 42 32 935.3

[51] Int. Cl.[6] ..... B01F 13/08

[52] U.S. Cl. ..... 366/273; 366/247; 416/3

[58] Field of Search ..... 366/64, 144, 147, 366/149, 242, 244, 245, 247, 249–251, 262–265, 270, 273, 274, 281, 282; 464/22, 29; 416/3; 417/420

[56] References Cited

U.S. PATENT DOCUMENTS

| | | | |
|---|---|---|---|
| 2,556,854 | 6/1951 | Spears et al. | 416/3 X |
| 3,508,882 | 4/1970 | Farnell | 366/149 X |
| 3,694,341 | 9/1972 | Luck, Jr. | 366/273 X |
| 4,120,618 | 10/1978 | Klaus | 417/420 |
| 4,235,569 | 11/1980 | Wegner et al. | 416/3 X |
| 4,460,278 | 7/1984 | Matsubara et al. | 366/149 |
| 4,722,661 | 2/1988 | Mizuno | 417/420 X |
| 4,752,194 | 6/1988 | Wienen et al. | 417/420 |
| 4,993,841 | 2/1991 | Lofgren et al. | 366/314 X |
| 5,240,322 | 8/1993 | Haber et al. | 366/273 X |

FOREIGN PATENT DOCUMENTS

| | | | |
|---|---|---|---|
| 210651 | 2/1987 | European Pat. Off. . | |
| 399972 | 11/1990 | European Pat. Off. | 366/273 |
| 1905322 | 8/1970 | Germany . | |
| 3637863 | 5/1988 | Germany . | |
| 3839693 | 5/1990 | Germany . | |
| 3942679 | 6/1991 | Germany . | |
| 58-124092 | 7/1983 | Japan | 416/3 |
| 60-125240 | 7/1985 | Japan | 366/273 |
| 1130722 | 5/1989 | Japan | 366/273 |

*Primary Examiner*—Charles E. Cooley
*Attorney, Agent, or Firm*—Michael J. Striker

[57] ABSTRACT

A stirring apparatus has a stirring shaft, a drive, a stirring tool, and a contactlessly operating coupling for transmitting a driving moment from the drive through the stirring apparatus shaft to the stirring tool. The contactlessly operating coupling is arranged between the stirring shaft and the stirring tool, and a pipe is provided inside which the stirring shaft is arranged.

6 Claims, 2 Drawing Sheets

MAGNETIC STIRRING APPARATUS WITH CONTACTLESS COUPLING BETWEEN STIRRING SHAFT AND STIRRING TOOL

CROSS-REFERENCE TO RELATED APPLICATION

This application is a continuation-in-part application of application Ser. No. 08/129,421 filed on Sept. 30, 1993.

BACKGROUND OF THE INVENTION

The present application relates to a top-mounted stirring apparatus with a stirring shaft, a drive, stirring tool and contactless coupling for transmitting drive movement from the drive through the stirring apparatus shaft to the stirring tool. The apparatus is to be mounted on the upper wall of the vessel.

Stirring apparatus of this general type are known in the art. They are formed as for example as permanently magnetic rotary stirring apparatuses. The rotary transmission between the drive motor and the stirring shaft operates in accordance with the principle of the magnetic radial coupling. The outer coupling part is connected with an electric motor having a steplessly regulatable transmission and displaces the inner coupling part through an air gap into a rotary movements in synchronous with the transmissions. Alternatively, hydraulic, pneumatic or other types of transmission can be used. A gap pipe composed of paramagnetic material is arranged in the air gap between the inner and outer coupling parts. It can be connected for example through a cooling column with an autoclave inner chamber while the inner drive system is pressure-tightly closed from the autoclave inner chamber. The cooling column therefore separates the high autoclave temperatures from the magnetic system and the bearing.

The gap pipe with the subsequent cooling column together with the autoclave inner chamber represents a joint volume. Since inside the cooling column the stirring shaft is arranged and supported with respect to the gap pipe, a seal must be provided inside the gap pipe and the connected cooling column. It separates the autoclave chamber from the volume of the gap pipe or cooling pipe so that the stirrer bearing is protected from the autoclave atmosphere. The rotatable stirring apparatus shaft extends through the seal into the autoclave inner chamber. The bearing of this freely extending shaft end poses certain problems since the shaft can be easily deflected under the reaction forces and has tendency to vibrations.

In particular, for performing the microbiological processes, the seals between the rotatable stirring shaft and the stationary gap or cooling pipe must not be compromised. The result can be the loss of the whole charge.

The seals and bearings in the known magnetic stirring apparatus always constitute weak points and act especially disadvantageously in aseptic and sterile applications. The upper part of the gap pipe or the cooling pipe has without ventilation a constant air cushion which cannot be sterilized or is sterilized insufficiently in the autoclaves. The bearing also cannot be lubricated. Without suitable bearing, however, the stirring shaft cannot be formed substantially long. The bearing provided in the gap pipe and the seals form uncontrollable regions in which microorganisms can deposit. Even expensive seals with blocking medium cannot satisfactorily solve these problems.

SUMMARY OF THE INVENTION

Accordingly, it is an object of the present invention to provide a stirring apparatus which avoids the disadvantages of the prior art.

In keeping with these objects and with others which will become apparent hereinafter, one feature of the present invention resides, briefly stated, in a top-mounted stirring apparatus in which the contactless coupling is provided between the stirring shaft and the stirring tool, wherein the stirring shaft is arranged inside a pipe. The pipe serves as a guiding pipe for the stirring shaft. Thereby it is possible to provide any length, since the shaft support can be extended up to the coupling. Normal materials can be used without problems inside the guiding pipe. The pipe has no dead zones. It can be simply cleaned and sterilized. Moreover, sensitive additional sliding ring seals are avoided. The product in the autoclave is hermetically sealed from the environment.

In accordance with one embodiment of the invention the stirring tool is rotatably supported on the pipe, in particular by a sliding bearing, and the bearing is lubricated preferably by the medium to be stirred. Due to this, bearing vibrations are avoided in the stationary pipe. The service life expectation of the bearing is increased. In particular cases it suffices to provide a radial bearing, since in secondary cases the axial hold of the stirring tool is performed by the magnetic force.

In accordance with a further embodiment of invention, the stirring shaft is supported at least at two points inside the pipe. The deflections of the stirring shaft known in the prior art are advantageously eliminated by this feature. Critical rotary speeds of the shaft are controlled. Also, in unfavorable structural edge conditions the stirring tool can be structurally provided on the location which is optimal for stirring and mixing.

Since the stirring tool is formed as an impeller with an inner surface partially surrounding the pipe and an outer surface provided with a passage which connects both surfaces, the self cleaning property of the stirring tool is improved. During the operation of the stirring tool the inner region around the bearing is constantly rinsed with the mixing product. In the case of cleaning, the cleaning liquid also reaches the poorly accessible locations in the region of the bearing.

When in accordance with a further feature, the passage has an inclination, the product or the cleaning liquid can run out after the emptying of the container from the stirring tool.

The hermetic separation of the container inner chamber is obtained when in accordance with the present invention the pipe is provided with a seal or a sealing surface at the end facing the drive.

The pipe can have a mounting flange at the end facing the drive. With this construction the mounting of the stirring apparatus on the container is facilitated.

The second coupling can also be arranged between the drive and the stirring shaft. This facilitates the dismounting of the stirring apparatus.

The pipe can be provided with an inner chamber which can be cooled or heated. This is advantageous in the temperature critical processes. For the same purpose the pipe can be coolable or heatable itself. For this purpose it can have, for example, a double wall. It is especially advantageous to provide such a stirring apparatus when it is utilized in containers for microbiological processes.

Structurally the stirring apparatus can be further simplified when the drive is arranged in the pipe, for example with elimination of the shaft.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
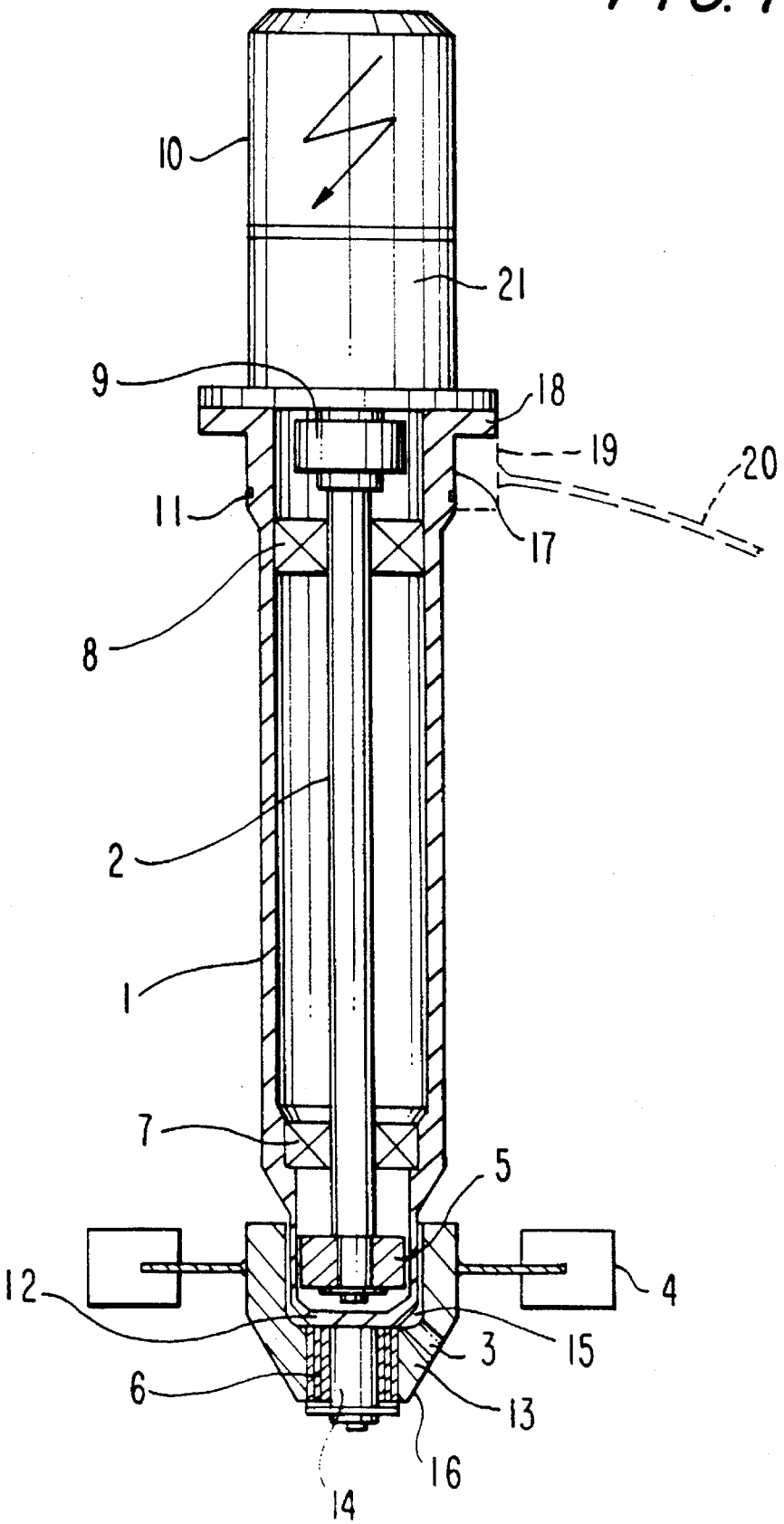
FIG. 1 of the drawings is a view showing an axial cross-section of a magnetic stirring apparatus in accordance with the present invention.

The top-mounted stirring apparatus in accordance with the present invention has a bearing and protective pipe which is identified with reference numeral 1. A drive or stirring shaft 2 is rotatably fixed inside of the pipe 1 by means of bearings 7 and 8. The lower end of the bearing and protective pipe 1 is formed as a cup-shaped gap pipe which forms a closure of the bearing and guiding pipe. The stirring shaft 2 extends into the gap pipe 12. At its lower end it is provided with a magnet disk 5 having a plurality of permanent magnets, for joint rotation with the magnet disk. The gap pipe 12 is partially surrounded from outside by an impeller head 13.

Opposite to the magnet disc 5 and inside the impeller head 13 a plurality of oppositely polarized permanent magnets are arranged so that due to the magnetic forces between the magnet disk 5 and the permanent magnets a torque can be transmitted from the drive shaft 2 to the impeller head 13 in a contactless manner. The stirring tool is formed by vanes 4 which are mounted on the webs of the impeller head 13. The support of the impeller is formed by a product-lubricated bearing 6. The bearing is arranged on a shaft end 14 which is formed downwardly on the gap pipe 12.

An inner depression with the surface 15 of the impeller 13 is connected through a passage 3 with the outer surface 16 of the impeller. During rotation of the impeller a pumping effect is produced by the partially radially outwardly directed passage 3. Thereby, the liquid located in the cup-shaped hollow chamber of the impeller 13 can flow outwardly. The inner surface of the impeller is thereby constantly rinsed with the product fluid and therefore a self-cleaning effect is produced.

The upper end of the guiding and bearing pipe extends in a guiding surface 17 with a subsequent mounting flange 18. A sealing groove with a seal 11 is formed in the guiding surface 17 and closes the gap between the guiding surface 17 and the mounting pipe 19 in a top container wall 20. In FIG. 1 the mounting pipe 19 and the wall 20 are shown in broken lines. As can be seen from FIG. 1, the bearing protective pipe 1 and the stirring shaft 2 extend downwardly into the vessel.

For driving the stirring shaft 2, the shaft is connected with a drive 10 through a coupling 9 and a transmission 21. The drive 10 and the transmission 21 are firmly screwed to the mounting flange 18 directly and axially therewith.

When the stirring apparatus is designed in accordance with the present invention, a very space economical and robust construction of the stirring apparatus is provided and therefore the disadvantages of the known stirring apparatuses are eliminated.

Figure 2:
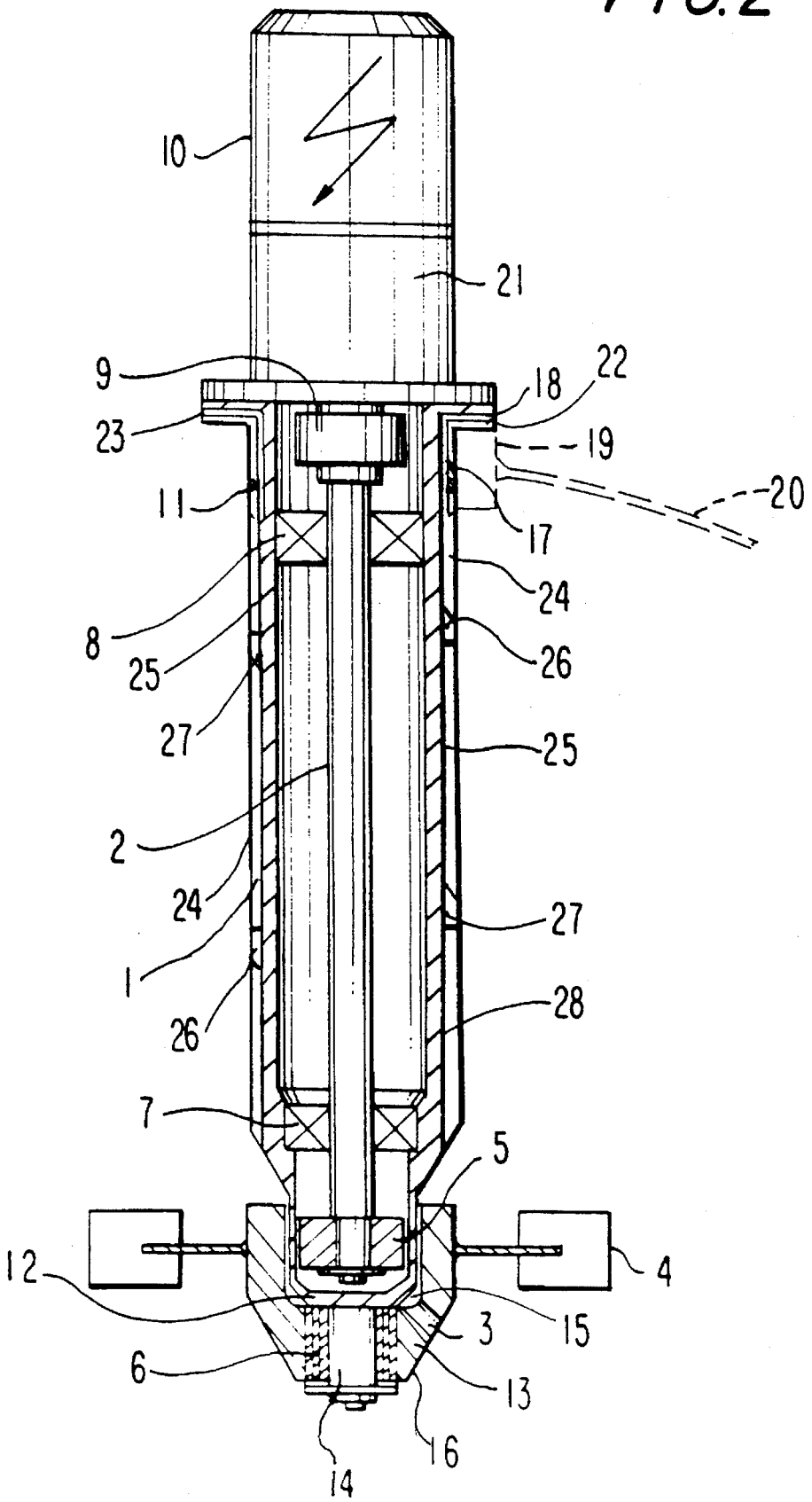
FIG. 2 is a view showing a fragment of the magnetic stirring apparatus in accordance with the present invention.

In certain cases stationary windings can be arranged inside the guiding pipe 1 to form the drive. With the corresponding control, for example by means of known stepper control they produce a rotary field which then provides the desired driving moment for the stirring apparatus in a contactless manner. As can be seen from FIG. 2 the pipe 1 has an inner chamber 28 connected with an inlet 22 and an outlet 23. The inner chamber is formed into a first helical conduit 24 and a second helical conduit 25 by a first helical sheet 26 and a second helical sheet 27. The first helical conduit is connected to the inlet and the second helical conduit is connected to the outlet, and both conduits are connected at the lower end of the pipe 1.

It will be understood that each of the elements described above, or two or more together, may also find a useful application in other types of construction differing from the types described above.

While the invention has been illustrated and described as embodied in a stirring apparatus or the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A magnetic stirring apparatus, comprising a vessel; a stirring shaft having a substantially vertical axis, and an upper and a lower end; a drive connected with said upper end of said stirring shaft so as to drive said stirring shaft; a stirring tool located in the region of said lower end of said stirring shaft; a contactlessly operating coupling for transmitting a driving movement from said stirring shaft downwardly to said stirring tool, said contactlessly operating coupling being arranged between said stirring shaft and said stirring tool; a pipe inside which the stirring shaft is arranged, said pipe having a lower end formed as a cup-shaped gap pipe, said stirring shaft extending into said gap pipe and being provided with a magnetic disc, means for mounting the apparatus on said vessel so that said stirring shaft and said stirring tool extend downwardly into said vessel; bearing means rotatably by holding said stirring shaft in said pipe and including two bearings axially spaced from one another, said two bearings being located inside said vessel; and further bearing means arranged inside said vessel and rotatably holding said stirring tool on said pipe.

2. A stirring apparatus as defined in claim 1, wherein said further bearing means include a sliding bearing which is lubricatable by a medium to be stirred.

3. A stirring apparatus as defined in claim 1, wherein said stirring tool is formed as impeller having an inner surface partially surrounding said pipe, an outer surface, and at least one passage connecting said surfaces with one another.

4. A stirring apparatus as defined in claim 3, wherein said impeller has a recess, said at least one passage being inclined relative to said recess.

5. A stirring apparatus as defined in claim 1, wherein said pipe has an end facing said drive and is provided with a mounting flange at said end.

6. A stirring apparatus as defined in claim 1; and further comprising a second coupling between said drive and said stirring shaft.

* * * * *